United States Patent [19]

Giovinazzi

[11] Patent Number: 4,664,297

[45] Date of Patent: May 12, 1987

[54] HOUSEHOLD REFRIGERATION VENTED BEVERAGE DISPENSER

[76] Inventor: Thomas Giovinazzi, 205 Coari Ave., Minotola, N.J. 08341

[21] Appl. No.: 794,670

[22] Filed: Nov. 4, 1985

Related U.S. Application Data

[63] Continuation-in-part of Ser. No. 662,096, Oct. 18, 1984, abandoned.

[51] Int. Cl.[4] ..... B67D 3/04

[52] U.S. Cl. ..... 222/185; 222/484; 222/590; 222/481.5

[58] Field of Search ..... 222/181, 185, 509, 518, 222/545, 484, 481–483; D7/70; 248/146; 137/218

[56] References Cited

U.S. PATENT DOCUMENTS

| | | | |
|---|---|---|---|
| 1,017,756 | 2/1912 | Head | 222/484 |
| 1,140,034 | 5/1915 | Hansen | 222/487 X |
| 1,207,505 | 12/1916 | Cordley | 222/484 X |
| 1,368,703 | 2/1921 | Czerny | 222/484 X |
| 2,065,785 | 12/1936 | Anschicks | 222/484 X |
| 2,364,206 | 12/1944 | Gardes | 222/484 X |
| 2,939,611 | 6/1960 | Nebinger | 222/484 X |
| 3,373,907 | 3/1968 | Batrow | 222/509 X |
| 3,376,582 | 4/1968 | Samuels | 222/509 X |
| 3,814,293 | 1/1973 | Daves | 222/173 |

FOREIGN PATENT DOCUMENTS

| | | | |
|---|---|---|---|
| 806764 | 12/1936 | France | 222/518 |

*Primary Examiner*—Joseph J. Rolla
*Assistant Examiner*—Nils Pedersen
*Attorney, Agent, or Firm*—B. P. Fishburne, Jr.

[57] ABSTRACT

A beverage dispenser particularly for home refrigerators includes a one-piece cradle which can support one or more large beverage bottles in an inclined mode to promote gravity discharge of the beverage. A dispensing valve can be directly coupled with the threaded necks of larger size bottles and with a threaded adapter can be coupled with the neck of a smaller size bottle. A vent tube connected with the dispensing valve extends deeply into the beverage bottle to avoid an air lock therein impeding flow through the valve. A pivoted valve operating lever, when moved to the valve opening beverage dispensing position against spring force, simultaneously opens the vent tube to atmosphere. When the lever is released to cause closing of the dispensing valve, an extension of the lever effects closing and sealing of the vent tube.

3 Claims, 6 Drawing Figures

HOUSEHOLD REFRIGERATION VENTED BEVERAGE DISPENSER

CROSS-REFERENCE TO RELATED APPLICATION

This application is a continuation-in-part of prior copending application Ser. No. 06/662,096, filed Oct. 18, 1984, for BEVERAGE DISPENSER, now abandoned.

BACKGROUND OF THE INVENTION

A need exists for an economical, convenient and efficient dispenser of beverages in a home refrigerator using large size one, two and three liter commercial beverage bottles as the source of the beverage being dispensed. Such bottles will not fit in most refrigerators while upright and therefore must be laid on their sides. When full of beverage, the large bottles are heavy and difficult to handle, particularly by children. Spilling of the beverage occurs frequently when an attempt is made to pour the beverage directly into a drinking glass from the large bottle. Frequent removal of the bottle cap, as well as failure to tighten the cap when it is replaced on the neck of the bottle, results in rapid loss of beverage carbonation.

While household refrigerator dispensers of beverages are known in the prior art, these generally are fairly complex and costly devices and therefore not completely practical. Moreover, known beverage dispensers are not designed to utilize the present day one, two and three liter plastic bottles as the source or supply of the beverage and do not include a simple cradle or support for such bottles.

The objective of the present invention is to satisfy the recognized need for a household refrigerator beverage dispenser which utilizes the above-described large beverage bottles at the supply or source of the beverage. More particularly, the present invention includes a low elevation one-piece cradle for one or more large bottles and supports the bottle or bottles on their sides at a shallow inclined angle sufficient to promote gravity flow of the beverage. A simplified positive acting dispensing valve having a direct threaded connection with the bottle neck or with an adapter coupled to the bottle neck allows the outflow of beverage from the bottle directly into a drinking glass without spilling, without the loss of carbonation to any significant degree, and without the necessity for lifting and manipulating the large bottle. Thus, the present invention eliminates the major drawbacks of the prior art noted above.

Another object and feature of the invention is to provide a venting system for the beverage dispenser which eliminates the possibility of air lock in the bottle during the outflow of beverage. In accordance with the invention, the venting system is open to atmosphere only during the outflow of beverage through the dispensing valve and is closed automatically when the valve returns to its normal closed non-dispensing position.

Other objects and advantages of the invention will become apparent to those skilled in the art during the course of the following detailed description.

DETAILED DESCRIPTION

Figure 1:
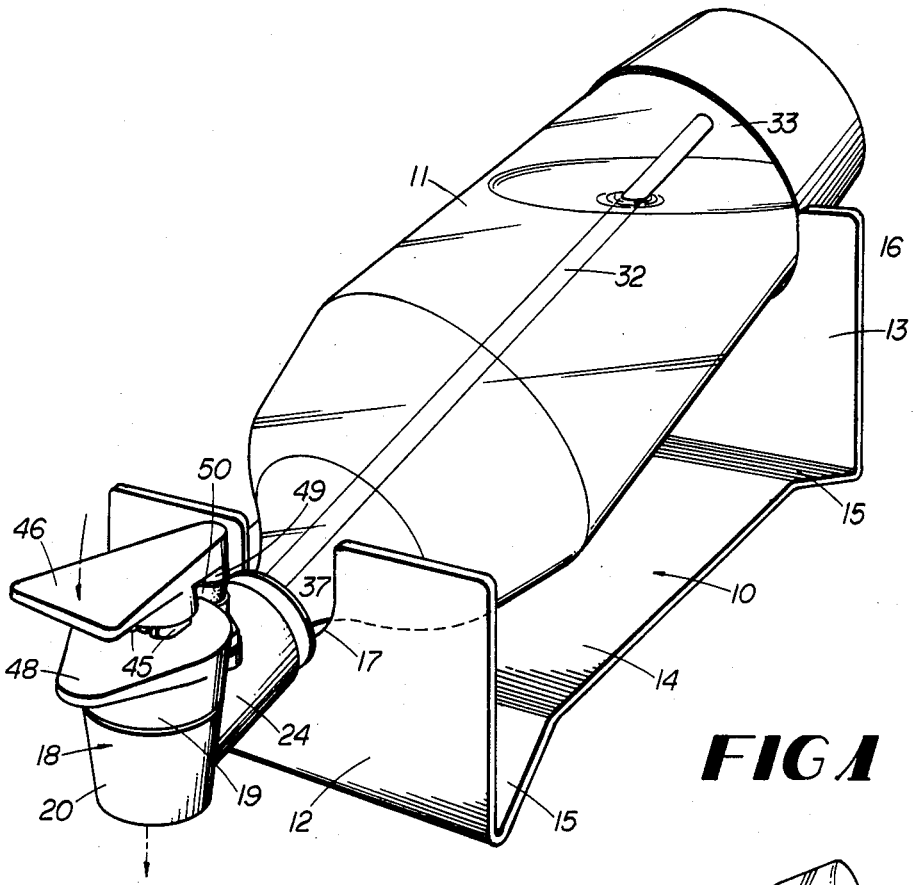
FIG. 1 is a perspective view of a beverage dispenser according to the present invention.

Referring to the drawings in detail wherein like numerals designate like parts, the numeral 10, FIG. 1, designates a support or cradle preferably formed of plastics material for easy cleaning and being adapted to hold a beverage bottle 11, such as a two liter or three liter commercial bottle formed of plastics material. The cradle 10 can be constructed to support a one liter bottle or even a four liter bottle in some cases. The cradle 10 includes two spaced opposing vertical end walls 12 and 13 and an interconnecting bottom wall 14 which is level when the cradle is at rest on a refrigerator shelf. The cradle is shaped to provide two depressed support feet 15 at its opposite ends for direct engagement with a refrigerator shelf or the like, the bottom wall 14 then being somewhat elevated from the shelf.

As shown in the drawings, the cradle 10 is constructed to hold a large beverage bottle in an inclined mode with its threaded outlet neck disposed lowermost to promote gravity discharge of the beverage. Preferably, the angle of inclination of the supported bottle is about 20°-25° to the horizontal although the angle is not extremely critical and can be varied.

The cradle end wall 13 has a relatively large arcuate recess 16 formed in its top edge to receive and support in a stable manner the base of the large beverage bottle 11. The recess 16 can be sized to receive a one, two or three liter bottle on the same cradle. Similarly, the opposite vertical wall 12 is provided with a slot 17 in its top edge which can be sized to receive and support the neck of a one, two or three liter bottle.

Figure 3:
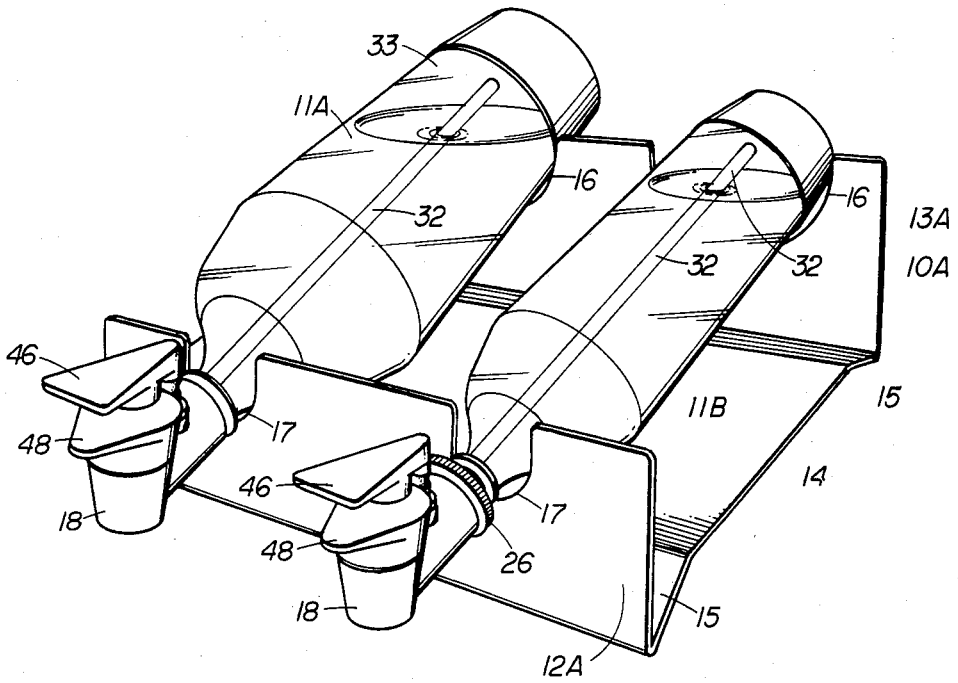
FIG. 3 is a perspective view of the invention showing a rest for supporting two beverage bottles.
Figure 4:
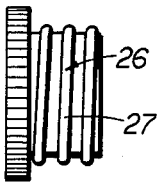
FIG. 4 is a side elevation of a threaded adapter.
Figure 5:
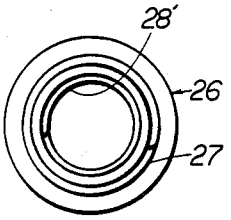
FIG. 5 is an end elevation of the same.

FIG. 3 of the drawings shows that the one-piece cradle designated by the numeral **10*a* can accommodate two side-by-side inclined beverage bottles 11*a* and 11*b* of different sizes, such as a two liter and three liter bottle, respectively. To facilitate this, the vertical walls 13*a* and 12*a* are each provided with a pair of the arcuate recesses 16 and neck-receiving slots 17. In all other respects, the dual bottle cradle 10*a* is constructed in the same manner as the single bottle cradle 10**.

The beverage dispenser further comprises a simple dispensing valve 18 of one size which can be used with all of the variously-sized beverage bottles mentioned above. The body of the dispensing valve 18 is preferably formed in two separable portions 19 and 20 which are threadedly connected as shown at 21 in FIG. 2. This two-part construction greatly facilitates cleaning the valve at frequent intervals. The valve 18 has a cylindrical plunger chamber 22 which is vertical during use, including a bottom end beverage outlet opening 23 which is conically tapered downwardly and is of lesser diameter than the cylindrical chamber 22.

The valve 18 includes on one side thereof an inclined tubular extension 24 molded integrally with the body portion 20 and being at an angle of 20°-25° to the horizontal during use to match the inclination of the beverage bottle. The extension 24 has internal screw-threads 25 at its outer end which are sized to receive directly the male threaded neck of a two liter or three liter bottle, such as the bottle 11 shown in FIG. 1.

When the valve 18 is used with a two liter bottle, such as the bottle 11*b*, FIG. 3, an internally and externally threaded tubular adapter coupling 26 is employed to couple the valve 18 with the neck of the two liter bottle 11*b*. The external threads 27 of the adapter coupling 26 are sized to enter the threads 25 of the valve extension 24, and the internal threads 28' of the adapter coupling are sized to receive the male threads on the neck of the two liter bottle, as shown in FIG. 3.

Figure 2:
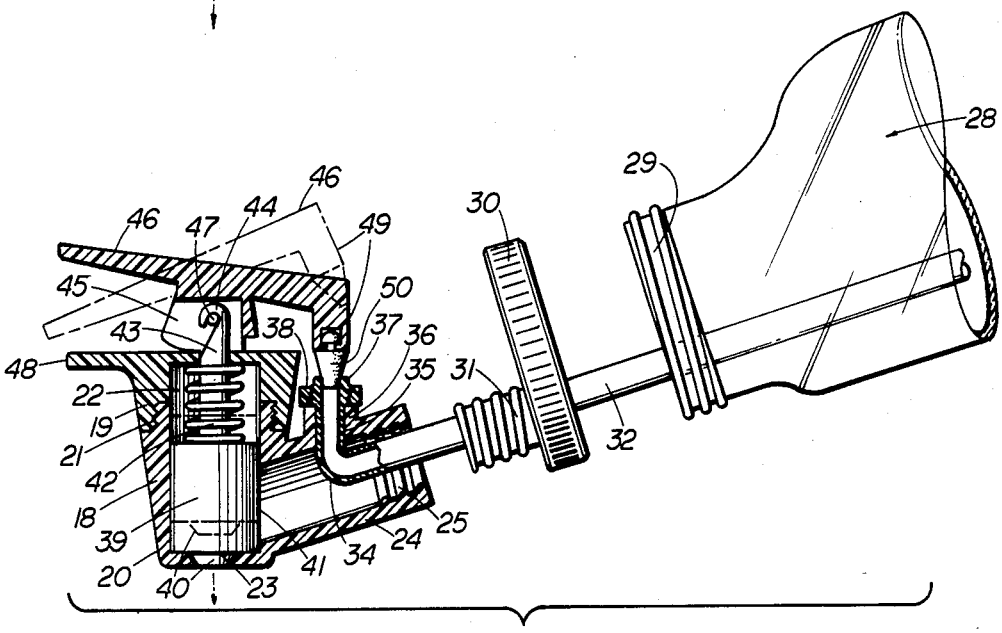
FIG. 2 is a vertical section taken through a beverage dispensing valve and bottle venting system and showing the valve in association with a wide mouth bottle and bottle adapter.
Figure 6:
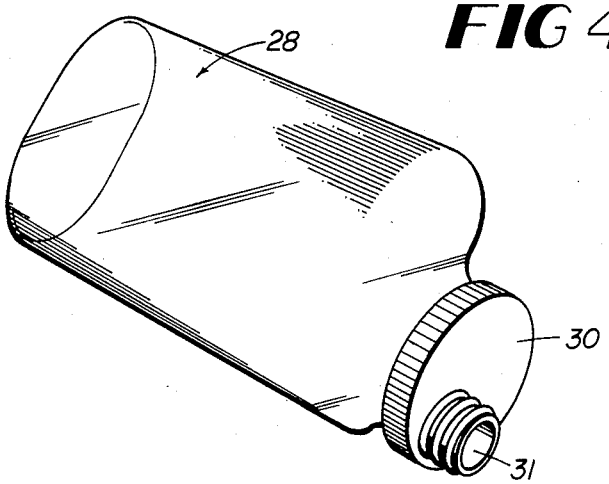
FIG. 6 is a perspective view of a wide mouth bottle and threaded adapter.

Similarly, if the beverage is dispensed from a wide mouth bottle 28, FIGS. 2 and 6, having a relatively large threaded neck 29, a threaded adapter cap 30 is employed having internal threads which are engageable with the threads 29 and having an eccentrically located externally threaded tubular nipple 31 whose threads are sized to engage within the threads 25 of the valve. The same type of cradle depicted in FIGS. 1 or 3 can be utilized to support the wide mouth bottle or jar 28 at the proper inclined angle.

The beverage dispenser includes an anti-airlock or venting system to facilitate fast drainage of the beverage from the bottle through the dispensing valve 18 when the latter is opened. This system comprises an elongated vent tube 32 adapted to project into an air space 33 near the base of the beverage bottle when the latter is being held in the inclined dispensing mode on the cradle 10. The vent tube is adapted to extend through the neck of the beverage bottle or through the adapter coupling 26 and neck in the case of a two liter bottle, or through the adapter cap 30 and nipple 31, FIG. 2, in the case of a wide mouth bottle. In any case, the tube projects into the angled tubular extension 24 and possesses the same angle of inclination as this extension. Within the extension 24, the venting tube 32 includes an elbow 34 having a vertical part 35 projecting through a short tubular nipple 36 on the extension or sleeve 24. A threaded terminal 37 on the vent tube immediately above the nipple 36 is secured by a nut 38. All of the described parts are preferably formed of plastics material.

The dispensing valve 18 further comprises a cylindrical plunger 39 within the chamber 22 having a reduced diameter conically tapered valve plug 40 at its lower end adapted to sealingly engage and close the tapered opening or seat 23 in a substantially liquid tight manner when the valve is closed through downward movement of the plunger 39. When the valve is closed, the outflow of beverage is also blocked by the plunger 39 where it intersects the bore 41 of the extension 24.

The plunger 39 is biased downwardly to its closed position against the bottom wall of the valve body by a compression spring 42 within the chamber 22. This spring surrounds a vertical stem 43 of the plunger 39 which projects through an opening in the top wall of the valve body and has a hook terminal 44 straddled by rocker webs 45 dependingly secured to a rockable valve opening lever 46. The rocker webs 45 engage the flat top wall of the valve body portion 19, as shown in FIG. 2. Lugs 47 on the webs 45 are pivotally engaged with the hook terminal 44 of the stem 43. In lieu of the lugs 47, a through pivot pin may be employed to connect the rockable lever 46 with the stem 43, if preferred.

The lever 46 extends forwardly of the neck of the beverage bottle and the cradle end wall 12. A finger grip extension 48 on the valve body lies beneath the forward end of the lever 46 to facilitate moving the lever to the valve opening and atmospheric position shown in FIG. 2 by squeezing finger action. When the lever 46 is rocked on the top wall of the valve body to the position shown in broken lines, the rocking action elevates the stem 43 and plunger 39 to unseat the tapered plug 40 and allow the outflow of beverage by gravity into a drinking glass or the like placed beneath the dispensing valve 18.

Simultaneously with the rockable lever 46 being swung to the valve opening position, FIG. 2, a vertical depending extension 49 carrying a conically tapered rubber-like seal 50 is swung away from the terminal 37 of vent tube 32. Consequently, at the moment the valve is opened to dispense beverage, the beverage bottle is vented to atmosphere to prevent the creation of an airlock therein, which would greatly impede the flow of the beverage through the valve. By virtue of the venting system, a drinking glass can be filled in about ten seconds, compared to more than one minute without the venting system.

When it is desired to close the valve 18, the lever 46 is merely released by the user and the force of the spring 42 will automatically close the valve plunger 39 and its plug 40 while simultaneously swinging the tapered seal 50 into air sealing engagement with the mouth of the terminal 37. Thus, the vent tube 32 will be open to atmosphere only during the times that the beverage is being dispensed through the valve 18. At all other times, the venting system is closed to prevent the loss of carbonation from the beverage. The home refrigerator beverage dispenser according to the invention is simple, convenient and diversified in that it can utilize one, two and three liter beverage bottles now on the market, and the four liter bottle soon to be on the market. The cradle can be constructed to support one bottle or several bottles of diverse sizes, such as illustrated in FIG. 3. One dispensing valve can be used with all bottle sizes as explained previously. The many advantages of the invention over the known prior art should now be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A household dispenser of beverages in large bottles comprising:

a cradle for a large beverage bottle adapted to rest on a shelf of a household refrigerator and supporting the large beverage bottle neck downwardly at an inclined angle to the horizontal to promote gravity flow of a beverage from the bottle, a dispensing valve unit having an internally threaded tubular extension at one side thereof adapted to be threadedly coupled with a threaded neck of a large beverage bottle resting on said cradle with the threaded tubular extension arranged at said inclined angle coaxially with said threaded neck, the dispensing valve unit further including a substantially vertical axis valve body having a vertical axis bore and a lower end beverage outlet opening leading from said bore, said valve body being integrally joined with the internally threaded tubular extension and the bore of the valve body being in communication with the interior of the tubular extension, a plunger within the bore of the valve body across the axis of the tubular extension and adapted in a downward position to close the beverage outlet opening, a spring within the bore of the valve body bearing on said plunger and biasing it downwardly, a stem on the top of said plunger projecting above the valve body and being received movably through an opening in the top of the valve body, a rockable lever on the dispensing valve unit rockably engaging the top face of the valve body and having a pivotal connection with said stem and being operable when rocked in one direction to elevate the stem and plunger against the force of said spring, an elastic seal carried by one end of the rockable lever and being spaced from one side of the valve body and being disposed above said tubular extension, an upstanding nipple on the tubular extension including an end terminal forming a seat for said elastic seal, and a vent tube for said dispenser adapted to extend deeply into a large beverage bottle on said cradle and having an upturned elbow within the tubular extension extending into said nipple and being joined to said end terminal forming said seat, whereby rocking of said lever in one direction to elevate said plunger simultaneously elevates the elastic seal from said seat to vent the beverage bottle and releasing of said lever enables said spring to return said plunger to said downward position and effect reseating of said elastic seal.

2. A household dispenser of beverages in large bottles as defined in claim 1, and said cradle being of one piece sheet material construction including forward and rear upstanding end walls, the forward end wall being provided in its top edge with a comparatively narrow slot adapted to receive and seat the neck of a large beverage bottle, and the rear end wall having a comparatively wide slot formed in its top edge to receive and seat the base portion of a large beverage bottle, the bottom of said comparatively wide slot being at an elevation above the bottom of the comparatively narrow slot, whereby the beverage bottle is supported on said cradle at said inclined angle to the horizontal.

3. A household dispenser of beverages from two or three liter plastic bottles, comprising a cradle for a two or three liter bottle adapted to rest on a household refrigerator shelf while supporting the bottle at an angle to the horizontal neck downwardly to promote gravity flow of a beverage from the bottle into a drinking receptacle, a dispensing valve unit having an internally threaded tubular extension on one side thereof adapted to be threadably coupled with a threaded neck of a beverage bottle resting on said cradle, said internally threaded tubular extension being arranged at said angle to the horizontal and coaxially aligned with said threaded neck, the dispensing valve unit further including a substantially vertical axis valve body having a vertical axis bore and a lower end beverage outlet opening leading from said bore, a plunger within the bore of the valve body across the axis of the tubular extension and adapted in a downward position to close the beverage outlet opening, a spring within the bore of the valve body engaging said plunger and biasing it downwardly, a stem on the top of said plunger projecting above the valve body and being received movably through an opening in the top of the valve body, a rockable lever on the dispensing valve unit rockably engaging a top face of the valve body and having a horizontal axis pivotal connection with said stem and being operable when rocked in one direction to elevate the stem and plunger against the biasing force of said spring, said rockable lever having a handle portion extending from one side of the axis of said plunger and having an arm extending from the opposite side of said axis to a point beyond one side of the valve body and above said tubular extension, an elastic downwardly tapering conical seal carried by said arm of the rockable lever, an upstanding nipple on said tubular extension including an upwardly facing seat for said seal, said seal being biased into sealing engagement with said seat by said spring when the rockable lever is in a released state, and a vent tube for said dispenser adapted to extend deeply into a beverage bottle resting on said cradle at said angle to the horizontal and including a part extending into said tubular extension and being in communication with said nipple.

* * * * *